US011603692B2

(12) United States Patent
Yun

(10) Patent No.: US 11,603,692 B2
(45) Date of Patent: Mar. 14, 2023

(54) LOCKING STRUCTURE FOR RECTILINEAR CENTER RAIL FOR OPPOSITE SLIDING DOORS

(71) Applicants: Hyundai Motor Company, Seoul (KR); Kia Motors Corporation, Seoul (KR)

(72) Inventor: Hyung-In Yun, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 461 days.

(21) Appl. No.: 16/776,921

(22) Filed: Jan. 30, 2020

(65) Prior Publication Data

US 2021/0087866 A1 Mar. 25, 2021

(30) Foreign Application Priority Data

Sep. 19, 2019 (KR) ..... 10-2019-0115495

(51) Int. Cl.

| | |
|---|---|
| ***E05D 15/06*** | (2006.01) |
| ***E05B 85/26*** | (2014.01) |
| ***E05B 83/40*** | (2014.01) |
| *E05D 15/10* | (2006.01) |

(52) U.S. Cl.

CPC ..... *E05D 15/0621* (2013.01); *E05B 83/40* (2013.01); *E05B 85/26* (2013.01); *E05D 2015/1031* (2013.01); *E05Y 2900/531* (2013.01)

(58) Field of Classification Search

CPC ..... E05D 15/0621; E05D 15/0686; E05D 15/063; E05D 2015/1031; E05B 83/40; E05B 85/26; E05Y 2900/531

See application file for complete search history.

(56) References Cited

U.S. PATENT DOCUMENTS

| | | | | |
|---|---|---|---|---|
| 4,464,863 | A | 8/1984 | Chikaraishi et al. | |
| 5,896,704 | A * | 4/1999 | Neag | E05D 15/1081 49/223 |
| 6,183,039 | B1 * | 2/2001 | Kohut | E05D 15/1081 296/146.12 |

(Continued)

FOREIGN PATENT DOCUMENTS

| | | | |
|---|---|---|---|
| CN | 101169026 | A | 4/2008 |
| CN | 104742701 | A | 7/2015 |

(Continued)

*Primary Examiner* — Kristina R Fulton
*Assistant Examiner* — James E Ignaczewski
(74) *Attorney, Agent, or Firm* — Slater Matsil, LLP

(57) ABSTRACT

A locking structure can be used for a rectilinear center rail for opposite sliding doors. A rectilinear center rail mounted in a longitudinal direction on a sliding door, a center roller unit rollably connected to the center rail, and a swing bracket rotatably connected to the center roller unit and a vehicle body. The center roller unit includes a first rotating member and a second rotating member, a first catcher formed on the center rail to hinder a movement of the center roller unit, a second catcher formed on the swing bracket to assist a movement of the center roller unit, and a first lever configured to be locked by or unlocked from the first catcher and a second lever configured to be locked by or unlocked from the second catcher are connected to the second rotating member.

20 Claims, 9 Drawing Sheets

(56) References Cited

U.S. PATENT DOCUMENTS

| | | | | |
|---|---|---|---|---|
| 7,000,977 | B2 | 2/2006 | Anders | |
| 8,282,156 | B1 * | 10/2012 | Thiele | E05F 5/003 296/207 |
| 9,475,368 | B2 | 10/2016 | Choi | |
| 9,493,056 | B2 * | 11/2016 | Choi | B60J 5/047 |
| 2008/0100091 | A1 * | 5/2008 | Kunishima | E05D 15/1081 296/146.1 |
| 2008/0231074 | A1 | 9/2008 | Suzuki et al. | |
| 2011/0126466 | A1 | 6/2011 | Adachi et al. | |
| 2014/0075843 | A1 * | 3/2014 | Maruyama | B60J 5/06 49/404 |
| 2014/0110966 | A1 | 4/2014 | Kwon et al. | |
| 2014/0157550 | A1 | 6/2014 | Yun et al. | |
| 2015/0183303 | A1 * | 7/2015 | Choi | E05D 15/0621 49/404 |
| 2016/0129769 | A1 * | 5/2016 | Choi | E05B 85/24 49/159 |
| 2018/0100335 | A1 * | 4/2018 | Yun | E05B 77/54 |

FOREIGN PATENT DOCUMENTS

| | | | |
|---|---|---|---|
| JP | 2008231747 | A | 10/2008 |
| KR | 100558413 | B1 | 3/2006 |
| KR | 101428255 | B1 | 8/2014 |
| KR | 101886445 | B1 | 8/2018 |

* cited by examiner

LOCKING STRUCTURE FOR RECTILINEAR CENTER RAIL FOR OPPOSITE SLIDING DOORS

CROSS-REFERENCE TO RELATED APPLICATIONS

This application claims priority to Korean Patent Application No. 10-2019-0115495, filed in the Korean Intellectual Property Office on Sep. 19, 2019, which application is hereby incorporated herein by reference.

TECHNICAL FIELD

The present invention relates to a locking structure for a rectilinear center rail for opposite sliding doors.

BACKGROUND

In general, a vehicle has an occupant compartment having a predetermined size in which a driver or an accompanied occupant may be seated, and occupant compartment opening/closing doors are installed on a vehicle body to open or close the occupant compartment.

Sliding type occupant compartment opening/closing doors include a front sliding door installed at a front side in a longitudinal direction of a vehicle and a rear sliding door installed at a rear side in the longitudinal direction of the vehicle. The front sliding door and the rear sliding door are typically installed to be moved along rails mounted on a vehicle body or the doors.

Referring to FIGS. 1 and 2, in the case of the sliding type occupant compartment opening/closing door in the related art, a center rail 10 configured to support a middle portion of the door during a process of opening or closing the door is curvedly formed.

In general, a door glass 3 is mounted to be moved upward or downward in a space between a door inner panel 6 and a door outer panel 7 that constitute a door 1. When the curved center rail 10 is mounted on the door 1, one end of the center rail 10 is curved and directed toward the door outer panel 7. In a region (see part X in FIG. 2) where one end of the center rail 10 is curved, the space between the door inner panel 6 and the door outer panel 7 is decreased, and thus the space in which the door glass 3 is mounted is decreased.

That is, in the vehicle mounted with the curved center rail 10, because a flag type outside mirror 4 needs to be applied and division channels 5*a* and 5*b* need to be applied to the front door and the rear door, there are problems in that a degree of design freedom is restricted and costs are increased due to the additional application of the above-mentioned components.

As an example of the technology in the related art mounted with the curved center rail, there is Korean Patent No. 10-0558413 (Center Roller Structure for Power Sliding Door).

SUMMARY

The present invention relates to a locking structure for a rectilinear center rail for opposite sliding doors. Particular embodiments relate to a locking structure for a rectilinear center rail that is capable of being locked by or unlocked from the center rail in a vehicle in which the rectilinear center rails are mounted on the sliding doors.

Embodiments of the present invention have been made in an effort to provide a structure capable of being locked by or unlocked from a rectilinear center rail in a simple configuration in which the rectilinear center rail is applied to a sliding door to improve a degree of design freedom.

An exemplary embodiment of the present invention provides a locking structure for a rectilinear center rail for opposite sliding doors. The locking structure includes a rectilinear center rail mounted in a longitudinal direction on a sliding door. A center roller unit is rollably connected to the center rail and a swing bracket is rotatably connected to the center roller unit and a vehicle body. The center roller unit includes a first rotating member and a second rotating member rotatable about a rotation axis formed in a width direction of the center rail.

Here, a first catcher configured to be caught by a catching portion formed on the center rail to hinder a movement of the center roller unit and a second catcher configured to be caught by a catching portion formed on the swing bracket to assist a movement of the center roller unit are connected to the first rotating member, and a first lever configured to be locked by or unlocked from the first catcher and a second lever configured to be locked by or unlocked from the second catcher are connected to the second rotating member.

According to embodiments, since the rectilinear center rail is applied to the sliding door, the degree of design freedom may be improved.

According to embodiments, because the locking structure for the rectilinear center rail is made by assembling constituent components thereof, only the broken components may be separated and easily replaced with a new component.

According to embodiments, the simple catching or releasing operation of the locking structure for the rectilinear center rail may control the movement of the center roller unit.

DETAILED DESCRIPTION OF ILLUSTRATIVE EMBODIMENTS

Hereinafter, exemplary embodiments of a locking structure for a rectilinear center rail for opposite sliding doors according to the present invention will be described in detail with reference to the drawings. Terms or words used herein should not be interpreted as being limited to a general or dictionary meaning and should be interpreted as a meaning and a concept which conform to the technical spirit of the present invention based on a principle that an inventor can appropriately define a concept of a term in order to describe his/her own invention by the best method.

A locking structure for a rectilinear center rail for opposite sliding doors according to an exemplary embodiment of the present invention is applied to a rectilinear center rail 100 (hereinafter, referred to as a 'center rail') mounted in a longitudinal direction of a sliding door 1 (hereinafter, referred to as a 'door').

Specifically, the doors 1 include a front door and a rear door, and the locking structure for the rectilinear center rail for the opposite sliding doors according to the exemplary embodiment of the present invention is applied to the center rail 100 of the front door and/or the rear door. The locking structures for the rectilinear center rails for the opposite sliding doors, which are applied to the front door and the rear door, respectively, are identical in configuration and operational principle. In the present specification, for ease of description, an example in which the locking structure for the rectilinear center rail for the opposite sliding doors is applied to any one door 1 of the front door and the rear door will be described.

Figure 1:
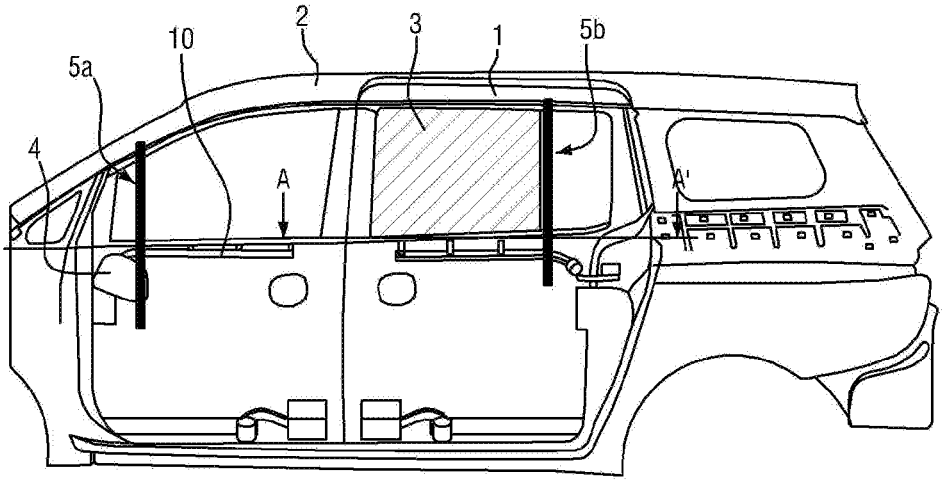
FIG. 1 is a view illustrating a state in which a curved center rail is applied to a sliding door in accordance with a technology in the related art.
Figure 2:
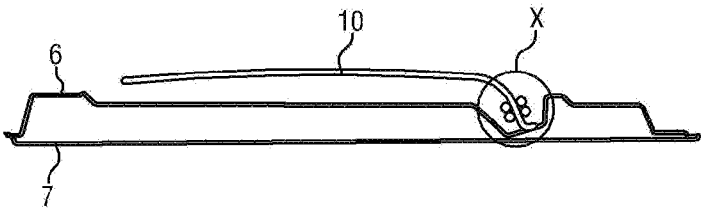
FIG. 2 is a view illustrating a cross section taken along line A-A' in FIG. 1.
Figure 3:
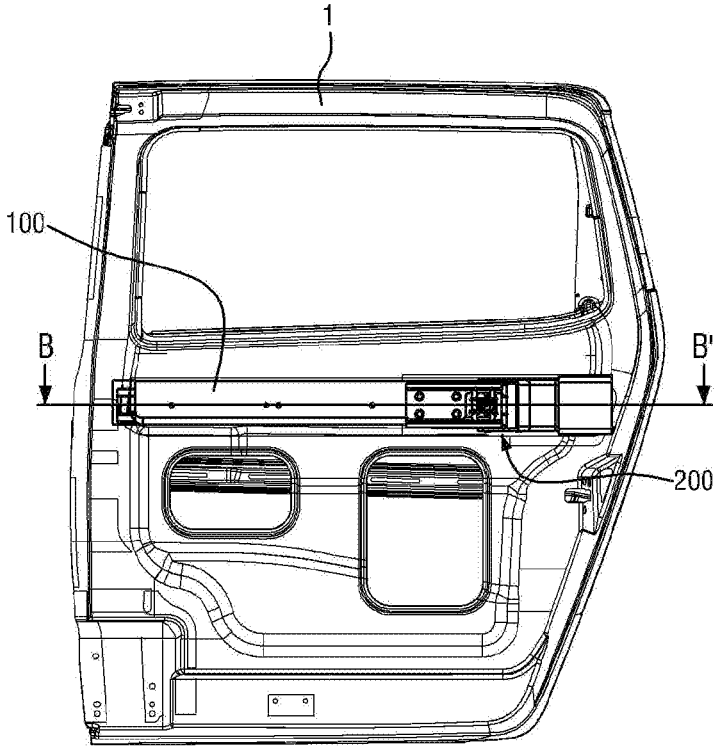
FIG. 3 is a view illustrating a state in which a locking structure for a rectilinear center rail for opposite sliding doors according to an exemplary embodiment of the present invention is applied to the sliding door.
Figure 4:
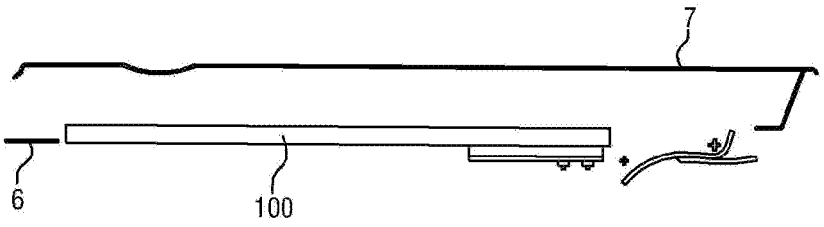
FIG. 4 is a view illustrating a cross section taken along line B-B' in FIG. 3.

FIG. 3 is a view illustrating a state in which the locking structure for the rectilinear center rail for the opposite sliding door according to the exemplary embodiment of the present invention is applied to the sliding door, and FIG. 4 is a view illustrating a cross section taken along line B-B' in FIG. 3.

Referring to FIGS. 3 and 4, the center rail 100 according to the exemplary embodiment of the present invention has a rectilinear shape. That is, unlike the curved center rail 10 mounted on the door 1, the rectilinear center rail 100 is parallel to a door inner panel 6 and a door outer panel 7 of the door 1, and one end of the center rail 100 is not directed toward the inside of the door 1. Therefore, a space between the door inner panel 6 and the door outer panel 7 of the door 1 may be utilized, and a degree of design freedom is higher when the rectilinear center rail 100 is mounted on the door 1 than when the curved center rail 10 is mounted on the door 1.

A center rail groove 102, which is elongated in a longitudinal direction, is formed in the center rail 100, and the center rail groove 102 serves as a movement route of a center roller unit 200 to be described below.

Figure 5:
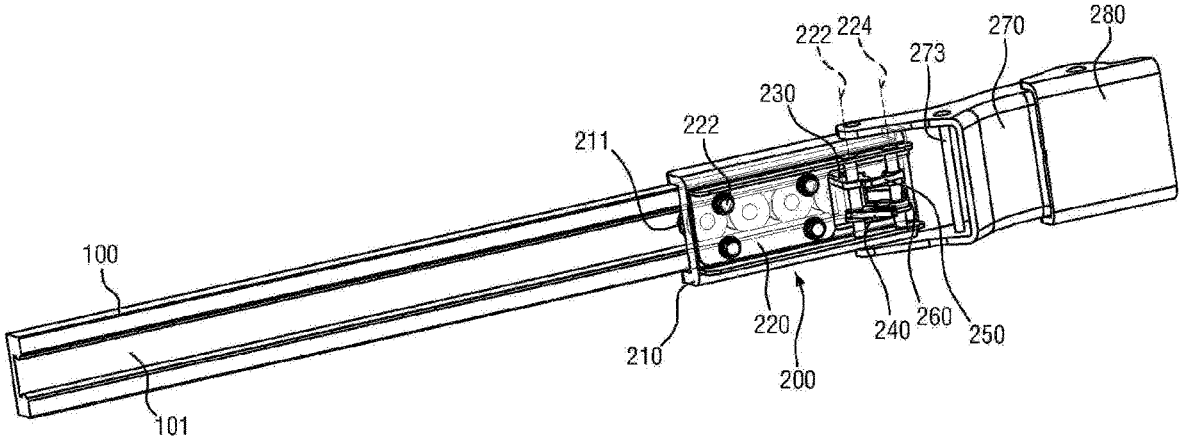
FIG. 5 is a view illustrating a state in which a center roller unit and the center rail according to the exemplary embodiment of the present invention are coupled to each other.
Figure 6:
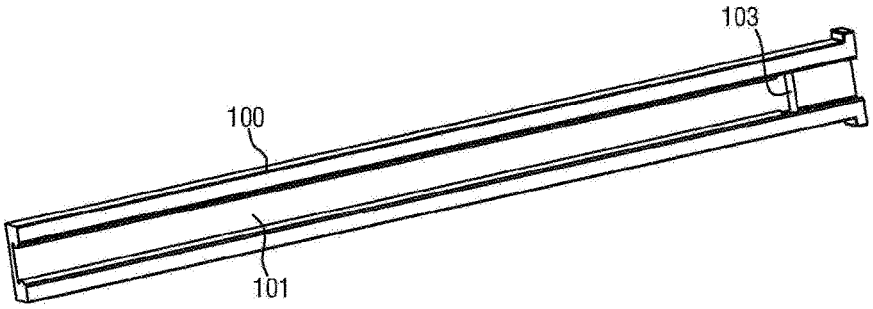
FIG. 6 is a view illustrating the center rail according to the exemplary embodiment of the present invention.
Figure 7:
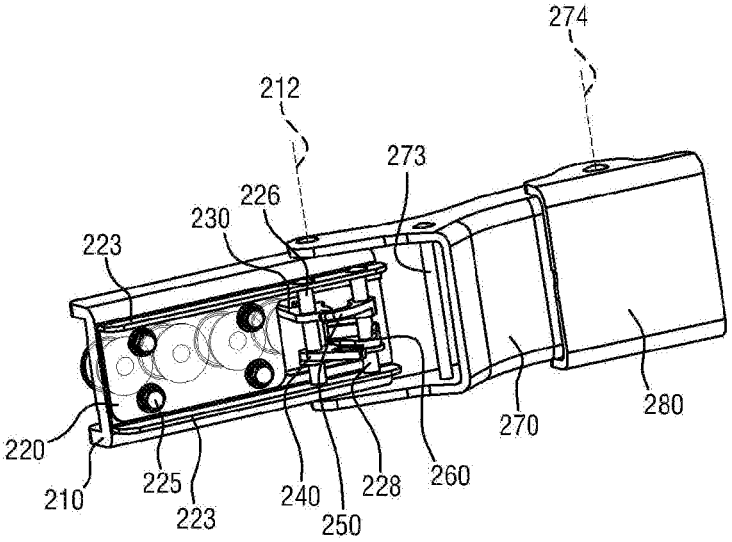
FIG. 7 is a view illustrating the center roller unit according to the exemplary embodiment of the present invention.

FIG. 5 is a view illustrating a state in which the center roller unit and the center rail according to the exemplary embodiment of the present invention are coupled to each other, FIG. 6 is a view illustrating the center rail according to the exemplary embodiment of the present invention, and FIG. 7 is a view illustrating the center roller unit according to the exemplary embodiment of the present invention.

Referring to FIGS. 5 to 7, a center rail striker 103 is formed in a width direction of the center rail 100 according to the exemplary embodiment of the present invention. The center rail striker 103 is formed at one side of the center rail 100. When the door 1 is the rear door, the center rail striker 103 is formed at a right position of the center rail 100 based on FIG. 5. When the door 1 is the front door, the center rail striker 103 is formed at a left position of the center rail 100 based on FIG. 5.

The center roller unit 200 is rollably coupled to the center rail 100. The center roller unit 200 includes a sliding bracket 210, a connecting bracket 220, a first rotating member 226, and a second rotating member 228.

A bearing 211 is rotatably connected to one side of the sliding bracket 210. The bearing 211 is seated on the center rail groove 101 and may be rotated while coming into contact with both sidewalls of the center rail groove 101. The connecting bracket 220 is fastened to the other side of the sliding bracket 210 through connecting members 225.

A swing bracket 270 is rotatably connected to one side of the sliding bracket 210. Therefore, the swing bracket 270 may be rotated about a first rotation axis 212. The swing bracket 270 is rotatably connected to a mounting bracket 280 fixed to a vehicle body 2. Therefore, the swing bracket 270 may be rotated about a second rotation axis 274.

The swing bracket 270 has a center roller striker 273 formed in the width direction of the center rail 100. Therefore, the center roller striker 273 is also rotated along a rotation route made as the swing bracket 270 is rotated.

Connecting sidewalls 223 are formed at both sides of the connecting bracket 220. The first rotating member 226 and the second rotating member 228, which will be described below, are rotatably connected to the connecting sidewalls 223. Therefore, the first rotating member 226 may be rotated about a third rotation axis 222, and the second rotating member 228 may be rotated about a fourth rotation axis 224. The first rotating member 226 and the second rotating member 228 face each other at positions parallel to each other in the longitudinal direction of the center rail 100.

A first catcher 230 and a second catcher 250 are connected to the first rotating member 226, and a first lever 240 and a second lever 260 are connected to the second rotating member 228. Therefore, the first catcher 230 and the second catcher 250 are rotated when the first rotating member 226 is rotated, and the first lever 240 and the second lever 260 are rotated when the second rotating member 228 is rotated. The first catcher 230, the second catcher 250, the first lever 240, and the second lever 260 affect one another while rotating, and the operating processes thereof will be described after respective configurations thereof are specifically described.

Figure 8:
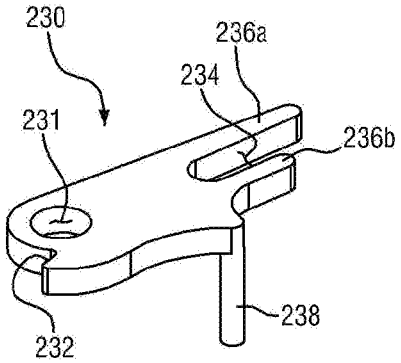
FIG. 8 is a view illustrating a first catcher according to the exemplary embodiment of the present invention.
Figure 9:
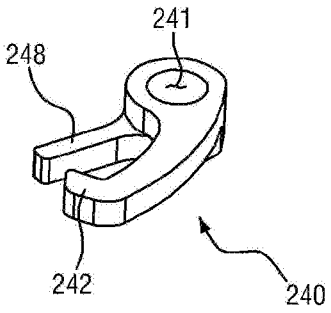
FIG. 9 is a view illustrating a first lever according to the exemplary embodiment of the present invention.
Figure 10:
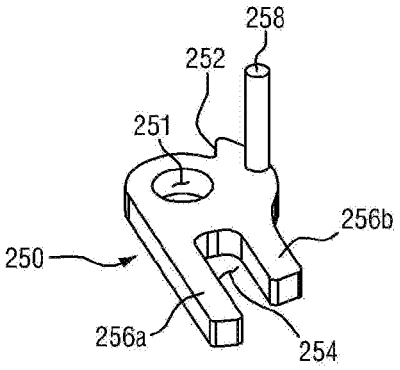
FIG. 10 is a view illustrating a second catcher according to the exemplary embodiment of the present invention.
Figure 11:
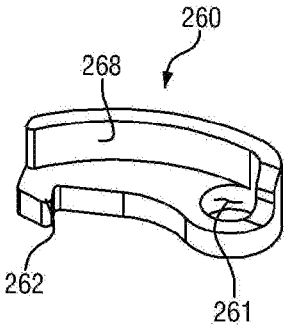
FIG. 11 is a view illustrating a second lever according to the exemplary embodiment of the present invention.

FIG. 8 is a view illustrating the first catcher according to the exemplary embodiment of the present invention, FIG. 9 is a view illustrating the first lever according to the exemplary embodiment of the present invention, FIG. 10 is a view illustrating the second catcher according to the exemplary embodiment of the present invention, and FIG. 11 is a view illustrating the second lever according to the exemplary embodiment of the present invention.

Referring to FIG. 8, the first catcher 230 includes a first catcher insertion hole 231, a first catching groove 232, a first insertion portion 234, and a first guide portion 238.

The first rotating member 226 is inserted into the first catcher insertion hole 231. The first catcher 230 is rotated together with the first rotating member 226 in the state in which the first rotating member 226 is inserted into the first catcher 230. That is, the first catcher 230 into which the first rotating member 226 is inserted is not rotated separately from the first rotating member 226. According to the exemplary embodiment of the present invention, an inner circumferential surface of the first catcher insertion hole 231 and an outer circumferential surface of the first rotating member 226 are fixed to be in close contact with each other.

The first lever 240 to be described below is locked by or unlocked from the first catching groove 232, such that the rotation of the first catcher 230 is restricted or not restricted. According to the exemplary embodiment of the present invention, the first catching groove 232 is shaped to be easily hook-coupled to the first lever 240.

The first insertion portion 234 is a portion into which the center rail striker 103 is inserted. The first insertion portion 234 is formed to approximately face the center rail 100 in the state in which the first catcher 230 is inserted into the first rotating member 226. First insertion guide protrusions 236*a* and 236*b* are formed at both sides of the first insertion portion 234, respectively. The first insertion guide protrusion 236*a* formed at one side of the first insertion portion 234 has a longer length than the first insertion guide protrusion 236*b* formed at the other side of the first insertion portion 234.

The first guide portion 238 is formed in a direction approximately perpendicular to one surface of the first catcher 230 (a lower surface of the first catcher based on FIG. 7) and extends to a position of the second lever 260.

Referring to FIG. 9, the first lever 240 includes a first lever insertion hole 241, a first hook portion 242, and a first guide corresponding portion 248.

The second rotating member 228 is inserted into the first lever insertion hole 241. The first lever 240 is rotated together with the second rotating member 228 in the state in which the second rotating member 228 is inserted into the first lever 240. That is, the first lever 240 into which the second rotating member 228 is inserted is not rotated separately from the second rotating member 228. According to the exemplary embodiment of the present invention, an inner circumferential surface of the first lever insertion hole 241 and an outer circumferential surface of the second rotating member 228 are fixed to be in close contact with each other.

The first hook portion 242 has a shape corresponding to the first catching groove 232 so that the first hook portion 242 is locked by or unlocked from the first catching groove 232 formed on the first catcher 230.

The first guide corresponding portion 248 is formed to face the first catcher 230 while being inclined at a predetermined angle with respect to the first hook portion 242.

Referring to FIG. 10, the second catcher 250 includes a second catcher insertion hole 251, a second catching groove 252, a second insertion portion 254, and a second guide portion 258.

The first rotating member 226 is inserted into the second catcher insertion hole 251. The second catcher 250 is rotated together with the first rotating member 226 in the state in which the first rotating member 226 is inserted into the second catcher 250. That is, the second catcher 250 into which the first rotating member 226 is inserted is not rotated separately from the first rotating member 226. According to the exemplary embodiment of the present invention, an inner circumferential surface of the second catcher insertion hole 251 and the outer circumferential surface of the first rotating member 226 are fixed to be in close contact with each other.

The second lever 260 to be described below is locked by or unlocked from the second catching groove 252, such that the rotation of the second catcher 250 is restricted or not restricted. According to the exemplary embodiment of the present invention, the second catching groove 252 is shaped to be easily hook-coupled to the second lever 260.

The second insertion portion 254 is a portion into which the center roller striker 273 is inserted. The second insertion portion 254 is formed to approximately face the swing bracket 270 in the state in which the second catcher 250 is inserted into the first rotating member 226. Second insertion guide protrusions 256*a* and 256*b* are formed at both sides of the second insertion portion 254, respectively. The second insertion guide protrusion 256*a* formed at one side of the second insertion portion 254 has a longer length than the second insertion guide protrusion 256*b* formed at the other side of the second insertion portion 254.

The second guide portion 258 is formed in a direction approximately perpendicular to one surface of the second catcher 250 (an upper surface of the second catcher based on FIG. 8) and extends to a position of the first lever 240. The second guide portion 258 may rotate the first lever 240 while rotating and coming into contact with the first guide corresponding portion 248 of the first lever 240.

Referring to FIG. 11, the second lever 260 includes a second lever insertion hole 261, a second hook portion 262, and a second guide corresponding portion 268.

The second rotating member 228 is inserted into the second lever insertion hole 261. The second lever 260 is rotated together with the second rotating member 228 in which the second rotating member 228 is inserted into the second lever 260. That is, the second lever 260 into which the second rotating member 228 is inserted is not rotated separately from the second rotating member 228. According to the exemplary embodiment of the present invention, an inner circumferential surface of the second lever insertion hole 261 and the outer circumferential surface of the second rotating member 228 are fixed to be in close contact with each other.

The second hook portion 262 has a shape corresponding to the second catching groove 252 so that the second hook portion 262 is locked by or unlocked from the second catching groove 252 formed on the second catcher 250.

The second guide corresponding portion 268 is positioned at one side of the second hook portion 262, configured as an approximately curved sidewall, and formed to face the second catcher 250. The first guide portion 238 of the first catcher 230 may rotate the second lever 260 while moving in a state of being in contact with an inner surface of the second guide corresponding portion 268.

Figure 12:
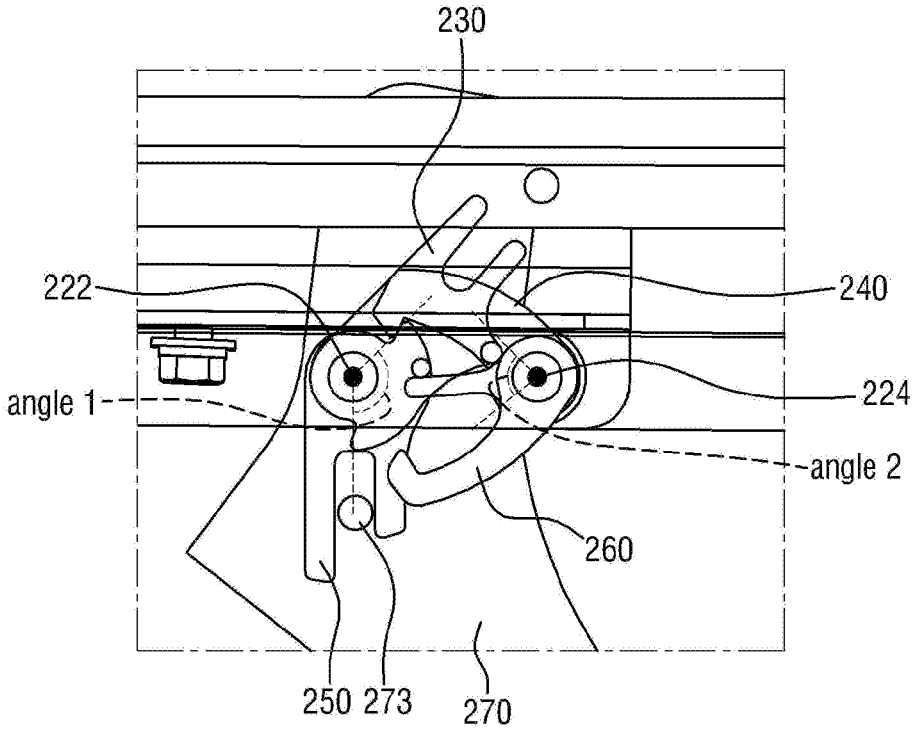
FIG. 12 is a view illustrating an angle between the first catcher and the second catcher and an angle between the first lever and the second lever when viewed from above.

FIG. 12 is a view illustrating an angle between the first catcher and the second catcher and an angle between the first lever and the second lever when viewed from above.

Referring to FIG. 12, the first catcher 230 and the second catcher 250 are inserted into the first rotating member 226 while having a predetermined angle 1 with respect to the third rotation axis 222 and may rotate while maintaining the predetermined angle 1. In addition, the first lever 240 and the second lever 260 are inserted into the second rotating member 228 while having a predetermined angle 2 with respect to the fourth rotation axis 224 and may rotate while maintaining the predetermined angle 2.

Figure 13:
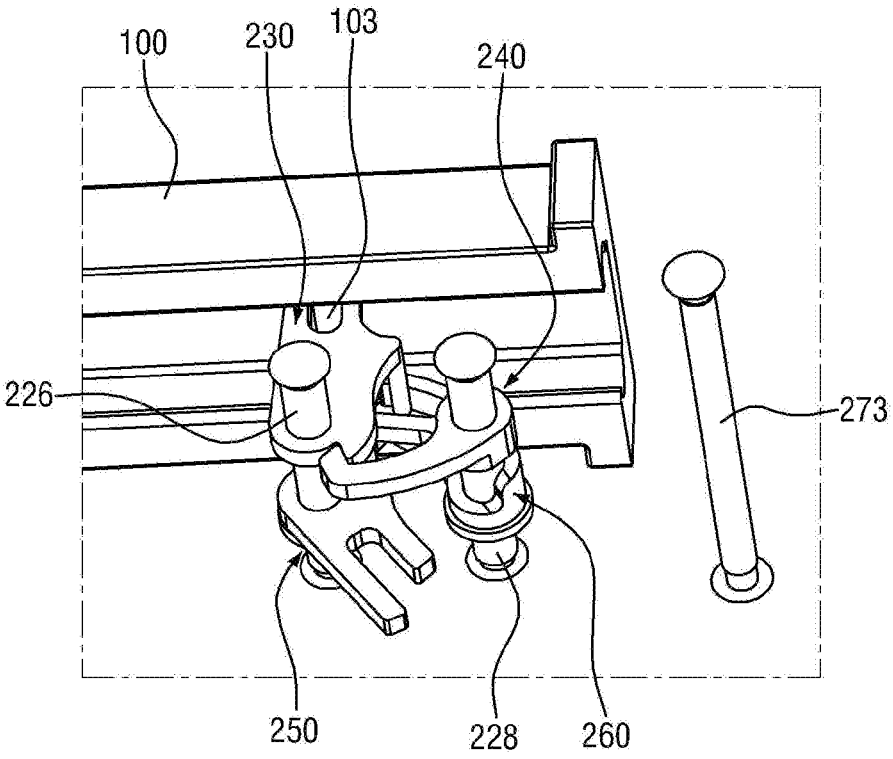
FIG. 13 is a view illustrating the locking structure for the rectilinear center rail in a state in which the sliding door being fully closed.
Figure 14:
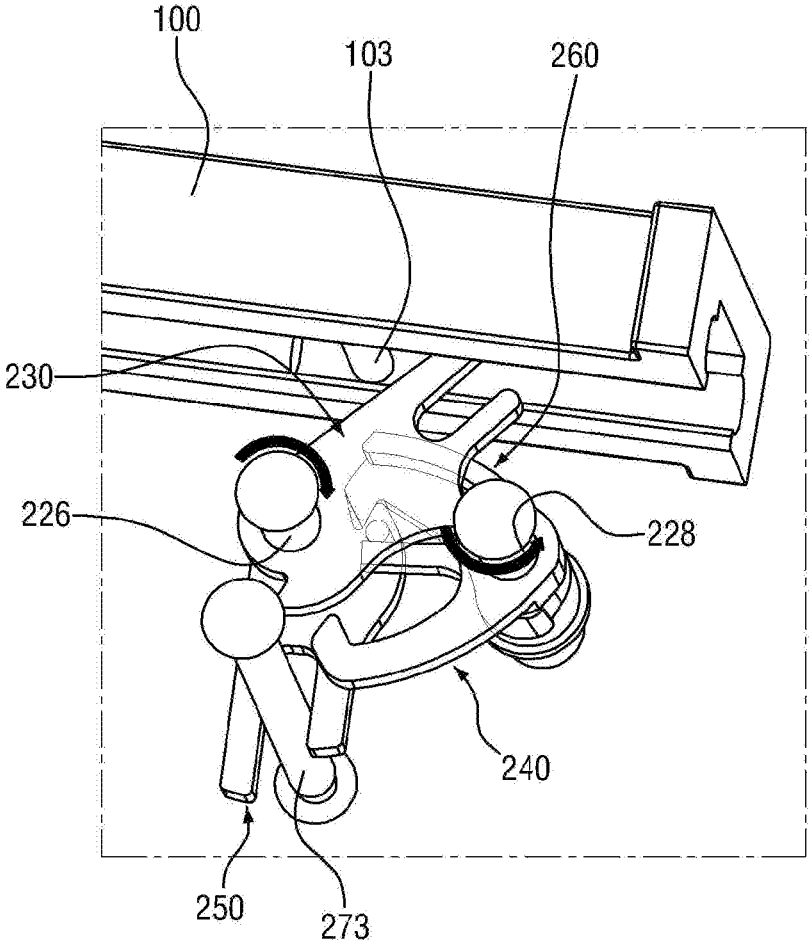
FIG. 14 is a view illustrating a state in which the locking structure for the rectilinear center rail is rotated when the state illustrated in FIG. 13 changes to an initially opened state of the sliding door.
Figure 15:
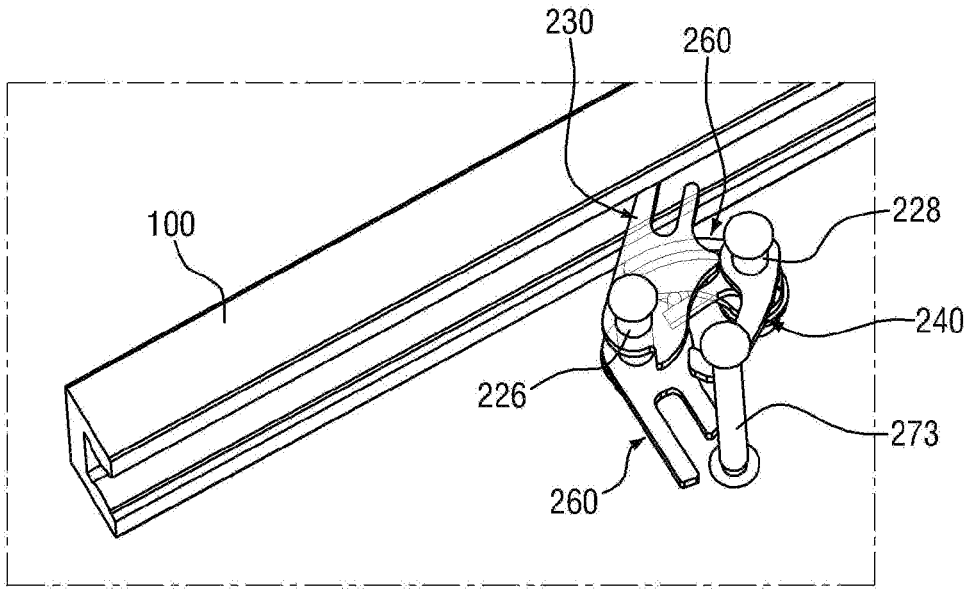
FIG. 15 is a view illustrating the locking structure for the rectilinear center rail in a fully opened state of the sliding door.
Figure 16:
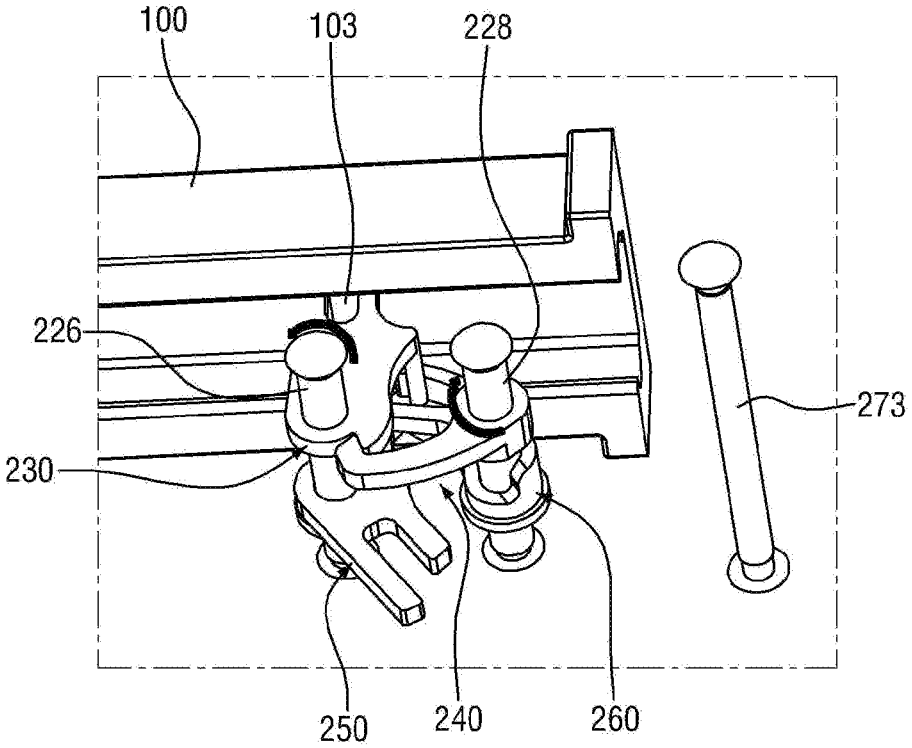
FIG. 16 is a view illustrating a state in which the locking structure for the rectilinear center rail is rotated when the state illustrated in FIG. 15 changes to a fully closed state of the door.

FIG. 13 is a view illustrating the locking structure for the rectilinear center rail in a fully closed state of the sliding door, FIG. 14 is a view illustrating a state in which the locking structure for the rectilinear center rail is rotated when the state illustrated in FIG. 13 changes to an initially opened state of the sliding door, FIG. 15 is a view illustrating the locking structure for the rectilinear center rail in a fully opened state of the sliding door, and FIG. 16 is a view illustrating a state in which the locking structure for the rectilinear center rail is rotated when the state illustrated in FIG. 15 changes to a fully closed state of the door.

Hereinafter, the operating process of the locking structure for the rectilinear center rail for the opposite sliding doors according to the exemplary embodiment of the present invention will be described with reference to FIGS. 13 to 16. For ease of description, FIGS. 13 to 16 illustrate only the components required for the operating process.

First, the operating process of the locking structure for the rectilinear center rail for the opposite sliding doors according to the exemplary embodiment of the present invention while the closed state of the door 1 changes to the opened state of the door will be described.

Referring to FIG. 13, in the fully closed state of the door 1, the center rail striker 103 is inserted into the first insertion portion 234 of the first catcher 230, and the first hook portion 242 of the first lever 240 and the first catching groove 232 of the first catcher 230 are hook-coupled. That is, because the first catcher 230 is caught by the center rail striker 103 and locked by the first lever 240, the door 1 is not moved even though a force is applied in a direction in which the door 1 is closed (a left direction based on FIG. 13). In this case, the second catcher 250 and the second lever 260 are unlocked.

Referring to FIG. 14, when a force is applied in a direction in which the door 1 is opened (a right direction based on FIG. 14) in the state illustrated in FIG. 13, the swing bracket 270 begins to rotate clockwise. In this case, the center roller striker 273 is rotated and caught by the long second insertion guide protrusion 256*a* of the second catcher 250 and then inserted into the second insertion portion 254, and the second catcher 250 and the first catcher 230 are rotated clockwise. At the same time, the second guide portion 258 of the second catcher 250 rotates the first lever 240 and the second lever 260 counterclockwise while coming into contact with the first guide corresponding portion 248 of the first lever 240. Meanwhile, the first guide portion 238 of the first catcher 230 is rotated clockwise along the inner surface of the second guide corresponding portion 268 of the second lever 260.

When the first guide portion 238 of the first catcher 230 is rotated in this direction, the center rail striker 103 is withdrawn from the first insertion portion 234 of the first catcher 230. In addition, the first catching groove 232 of the first catcher 230 and the first hook portion 242 of the first lever 240 are moved away from each other, and the state in which the first catcher 230 and the first lever 240 are locked changes to the state in which the first catcher 230 and the first lever 240 are unlocked. In addition, the second catching groove 252 of the second catcher 250 and the second hook portion 262 of the second lever 260 are moved close to each other, and the second hook portion 262 and the second catching groove 252 are hook-coupled, such that the state in which the second catcher 250 and the second lever 260 are unlocked changes to the state in which the second catcher 250 and the second lever 260 are locked.

In this state, the swing bracket 270 is stable without rotating any further, and the center roller unit 200 may move along the center rail 100 without being restricted by the center rail striker 103.

Referring to FIG. 15, when the force is applied to the direction in which the door 1 is opened (the right direction based on FIG. 15), the center roller unit 200 according to the exemplary embodiment of the present invention moves to one side of the center rail 100 (to the left based on FIG. 15) while still maintaining the state illustrated in FIG. 14, and the door 1 is fully opened.

Next, the operating process of the locking structure for the rectilinear center rail for the opposite sliding doors according to the exemplary embodiment of the present invention while the opened state of the door changes to the fully closed state of the door will be described.

Referring to FIG. 16, when the force is applied in the direction in which the door 1 is closed (the left direction based on FIG. 16) in the state illustrated in FIG. 15, the center roller unit 200 moves to the other side of the center rail 100 (to the right based on FIG. 16) and then reaches the vicinity of the center rail striker 103.

Here, when the force is further applied, the center rail striker 103 is caught by the long first insertion guide protrusion 236*a* of the first catcher 230 and then inserted into the first insertion portion 234, and the first catcher 230 and the second catcher 250 are rotated counterclockwise. In this case, the swing bracket 270 begins to rotate counterclockwise. At the same time, the first guide portion 238 of the first catcher 230 rotates the second lever 260 and the first lever 240 clockwise while rotating counterclockwise along the inner surface of the second guide corresponding portion 268 of the second lever 260. Meanwhile, the second guide portion 258 of the second catcher 250 is rotated together with the second catcher 250 in the state in which the second guide portion 258 is in contact with the first guide corresponding portion 248 of the first lever 240.

When the second guide portion 258 of the second catcher 250 is rotated in this direction, the center roller striker 273 inserted into the second insertion portion 254 of the second catcher 250 is withdrawn from the second insertion portion 254. In addition, the first catching groove 232 of the first catcher 230 and the first hook portion 242 of the first lever 240 are moved close to each other, and the first hook portion 242 and the first catching groove 232 are hook-coupled, such that the state in which the first catcher 230 and the first lever 240 are unlocked changes to the state in which the first catcher 230 and the first lever 240 are locked. In addition, the second catching groove 252 of the second catcher 250 and the second hook portion 262 of the second lever 260 are moved away from each other, and the second hook portion 262 is withdrawn from the second catching groove 252, such that the state in which the second catcher 250 and the second lever 260 are locked changes to the state in which the second catcher 250 and the second lever 260 are unlocked.

In this state, the center roller unit 200 is not moved any further along the center rail 100, but the swing bracket 270 is approximately parallel to the center rail 100.

The present invention has been described with reference to the limited exemplary embodiments and the drawings, but the present invention is not limited thereto. The described exemplary embodiments may be variously changed or modified by those skilled in the art to which the present invention pertains within the technical spirit of the present invention and within the scope equivalent to the appended claims.

What is claimed is:

1. A locking structure for a rectilinear center rail for opposite sliding doors, the locking structure comprising:
- a rectilinear center rail mounted in a longitudinal direction on a sliding door;
- a center roller unit rollably connected to the center rail; and
- a swing bracket rotatably connected to the center roller unit and a vehicle body;
- wherein the center roller unit comprises:
  - a first rotating member and a second rotating member rotatable about a rotation axis formed in a width direction of the center rail;
  - a first catcher configured to be caught by a catching portion formed on the center rail to hinder a movement of the center roller unit;
  - a second catcher configured to be caught by a catching portion formed on the swing bracket to assist a movement of the center roller unit are connected to the first rotating member; and
- a first lever configured to be locked by or unlocked from the first catcher and a second lever configured to be locked by or unlocked from the second catcher are connected to the second rotating member;
- wherein the first catcher and the second catcher are fixed to the first rotating member and are configured to be rotated together, and wherein the first lever and second lever are fixed to the second rotating member and configured to be rotated together.

2. The locking structure of claim 1, further comprising a center rail striker formed in a width direction on the center rail so that the first catcher can be caught by the center rail striker.

3. The locking structure of claim 1, further comprising a center roller striker formed on the swing bracket so that the second catcher can be caught by the center roller striker.

4. The locking structure of claim 3, wherein the first catcher comprises:
- a first insertion portion into which the center rail striker is inserted;
- a plurality of first insertion guide protrusions formed at both sides of the first insertion portion; and
- a first catching groove to be locked by or unlocked from the first lever.

5. The locking structure of claim 4, wherein the first lever comprises:
- a first hook portion configured to be caught by the first catching groove; and
- a first guide corresponding portion formed at one side of the first hook portion to assist a rotation of the first lever.

6. The locking structure of claim 5, wherein the second catcher comprises:
- a second insertion portion into which the center roller striker is inserted;
- a plurality of second insertion guide protrusions formed at both sides of the second insertion portion; and
- a second catching groove to be locked by or unlocked from the second lever.

7. The locking structure of claim 6, wherein the second lever comprises:
- a second hook portion configured to be caught by the second catching groove; and
- a second guide corresponding portion formed at one side of the second hook portion to assist a rotation of the second lever.

8. The locking structure of claim 7, wherein the first insertion guide protrusion is formed at one side among the plurality of first insertion guide protrusions and is longer than the first insertion guide protrusion formed at an opposite second side, and wherein the second insertion guide protrusion is formed at one side among the plurality of second insertion guide protrusions and is longer than the second insertion guide protrusion formed at the other side.

9. The locking structure of claim 7, wherein the first catcher includes a first guide portion configured to assist the second catcher and the second lever, when locked, in being unlocked from each other, and wherein the second catcher includes a second guide portion configured to assist the first catcher and the first lever, when locked, in being unlocked from each other.

10. The locking structure of claim 9, wherein the first lever includes a first guide corresponding portion configured to be in contact with the second guide portion, and wherein the second lever includes a second guide corresponding portion configured to be in contact with the first guide portion.

11. The locking structure of claim 10, wherein the second catcher and the first lever are configured to rotate in opposite directions when the second guide portion and the first guide corresponding portion come into contact with each other and rotate, and wherein the first catcher and the second lever are configured to rotate in opposite directions when the first guide portion and the second guide corresponding portion come into contact with each other and rotate.

12. The locking structure of claim 1, wherein an angle formed between the first catcher and the second catcher and an angle formed between the first lever and the second lever are predetermined on a plane of rotation based on the rotation axis.

13. A locking structure for a rectilinear center rail for opposite sliding doors, the locking structure comprising:
- a rectilinear center rail mounted in a longitudinal direction on a sliding door;
- a center roller unit rollably connected to the center rail; and
- a swing bracket rotatably connected to the center roller unit and a vehicle body;
- wherein the center roller unit comprises:
  - a first rotating member and a second rotating member rotatable about a rotation axis formed in a width direction of the center rail;
  - a first catcher configured to be caught by a catching portion formed on the center rail to hinder a movement of the center roller unit;
  - a second catcher configured to be caught by a catching portion formed on the swing bracket to assist a movement of the center roller unit are connected to the first rotating member; and
- a first lever configured to be locked by or unlocked from the first catcher and a second lever configured to be locked by or unlocked from the second catcher are connected to the second rotating member, wherein the first lever comprises:
  - a first hook portion configured to be caught by the first catching groove; and
  - a first guide corresponding portion formed at one side of the first hook portion to assist a rotation of the first lever.

14. The locking structure of claim 13, wherein the second catcher comprises:
- a second insertion portion into which the center roller striker is inserted;

a plurality of second insertion guide protrusions formed at both sides of the second insertion portion; and a second catching groove to be locked by or unlocked from the second lever.

15. The locking structure of claim 14, wherein the second lever comprises:

a second hook portion configured to be caught by the second catching groove; and a second guide corresponding portion formed at one side of the second hook portion to assist a rotation of the second lever.

16. The locking structure of claim 15, wherein the first insertion guide protrusion is formed at one side among the plurality of first insertion guide protrusions and is longer than the first insertion guide protrusion formed at an opposite second side, and wherein the second insertion guide protrusion is formed at one side among the plurality of second insertion guide protrusions and is longer than the second insertion guide protrusion formed at the other side.

17. The locking structure of claim 15, wherein the first catcher includes a first guide portion configured to assist the second catcher and the second lever, when locked, in being unlocked from each other, and wherein the second catcher includes a second guide portion configured to assist the first catcher and the first lever, when locked, in being unlocked from each other.

18. The locking structure of claim 17, wherein the first lever includes a first guide corresponding portion configured to be in contact with the second guide portion, and wherein the second lever includes a second guide corresponding portion configured to be in contact with the first guide portion.

19. The locking structure of claim 18, wherein the second catcher and the first lever are configured to rotate in opposite directions when the second guide portion and the first guide corresponding portion come into contact with each other and rotate, and wherein the first catcher and the second lever are configured to rotate in opposite directions when the first guide portion and the second guide corresponding portion come into contact with each other and rotate.

20. A locking structure for a rectilinear center rail for opposite sliding doors, the locking structure comprising:

a rectilinear center rail mounted in a longitudinal direction on a sliding door;

a center roller unit rollably connected to the center rail; and a swing bracket rotatably connected to the center roller unit and a vehicle body;

wherein the center roller unit comprises:

a first rotating member and a second rotating member rotatable about a rotation axis formed in a width direction of the center rail;

a first catcher configured to be caught by a catching portion formed on the center rail to hinder a movement of the center roller unit;

a second catcher configured to be caught by a catching portion formed on the swing bracket to assist a movement of the center roller unit are connected to the first rotating member; and a first lever configured to be locked by or unlocked from the first catcher and a second lever configured to be locked by or unlocked from the second catcher are connected to the second rotating member;

wherein the first catcher and the second catcher are fixed to the first rotating member and are configured to be rotated together, and wherein the first lever and second lever are fixed to the second rotating member and configured to be rotated together;

wherein an angle formed between the first catcher and the second catcher and an angle formed between the first lever and the second lever are predetermined on a plane of rotation based on the rotation axis.

* * * * *